United States Patent [19]

Laumann

[11] 3,950,578

[45] Apr. 13, 1976

[54] WATER-DISINTEGRATABLE SHEET MATERIAL

[75] Inventor: David H. E. Laumann, Freehold, N.J.

[73] Assignee: Richard S. Keoseian, New York, N.Y.

[22] Filed: June 9, 1971

[21] Appl. No.: 151,579

Related U.S. Application Data

[60] Division of Ser. No. 872,656, Oct. 30, 1969, Pat. No. 3,654,064, which is a continuation-in-part of Ser. No. 790,134, Jan. 9, 1969, abandoned.

[52] U.S. Cl. ..... 427/378; 427/389; 427/390; 427/412; 427/416

[51] Int. Cl.[2] ..... B05D 3/02; B05D 3/04

[58] Field of Search ..... 117/62, 63, 119.6, 119.8, 117/76 F, 76 P, 155 UA, 158, 92; 427/378, 389, 390, 412, 416

[56] References Cited

UNITED STATES PATENTS

| | | | |
|---|---|---|---|
| 3,078,849 | 2/1963 | Morse | 128/290 |
| 3,123,075 | 3/1964 | Stamberger | 128/287 |
| 3,196,038 | 7/1965 | Schoch et al. | 117/92 X |
| 3,251,709 | 5/1966 | Bonzagni | 117/92 X |
| 3,437,509 | 4/1969 | Coisne | 117/62 |
| 3,476,581 | 11/1969 | Weitzel et al. | 117/62 |
| 3,494,783 | 2/1970 | Kimura et al. | 117/76 |
| 3,639,148 | 2/1972 | Moore et al. | 117/76 |

*Primary Examiner*—Michael R. Lusignan

[57] ABSTRACT

Coated paper is provided in sheet, roll or other physical form and shape which is water-repellent when wetted on either side but which readily disintegrates when both sides are wetted as when the entire sheet is immersed in water. The paper is preferably of toilet or facial tissue quality or water-soluble or any other type, provided it is not wet-strength grade, which readily disintegrates in water. A water-soluble grade of non-woven fabric may also be used instead of paper. The paper is first covered with an extremely thin, (2 to about 5 pounds per ream) coating which does not appreciably penetrate into or impregnate the paper. The coating is preferably an extremely thin layer of polyethylene which serves as a hold-out coating for a subsequent water-repellent coating, preferably of wax, modified with ethyl vinyl acetate or synthetic rubbers and softeners. By flashing the polyethylene or other polymer hold-out layer with heat prior to application of the wax coating or by applying the modified wax at temperatures in the range of 185° to 235° F (depending on the speed of the wax coating operation) the stretch properties of the polyethylene are totally eliminated and yet the polyethylene serves as a hold-out coating for the flexible wax layer and prevents it from sinking into the tissue paper and rendering it water-insoluble and with wet strength properties. When an additional uncoated sheet of tissue paper is placed on top of the waxy insoluble coating the result is a sheet which repels water as well as the passage of bacteria and other micro-organisms on either side and maintains its strength but which, when wetted on both sides, readily disintegrates or dissolves much like an uncoated sheet of tissue paper. When wetted on one side the sheet derives its strength from the bottom layer of paper which is kept dry and strong by the water-repellent coating. The coating, itself, while flexible and virtually pin-hole free, has no stretch properties and is very weak. When both top and bottom layers of paper are wetted (as when flushed in a toilet) the entire sheet tears and disintegrates readily since there remains nothing to support the thin, weak water-insoluble coating. The sheet material is adapted for a variety of uses in the hospital, sanitary, nursing home and consumer fields and may be cut or shaped into sizes and configurations suitable for the particular intended use.

6 Claims, 8 Drawing Figures

WATER-DISINTEGRATABLE SHEET MATERIAL

This application is a division of my application Ser. No. 872,656 filed Oct. 30, 1969, and now U.S. Pat. No. 3,654,064 granted Apr. 4, 1972, which is a continuation in part of application Ser. No. 790,134 filed Jan. 9, 1969 and now abandoned.

This invention relates to sheet material in strip, sheet or roll form which is water-repellant when wetted on one side (or either side) but which is readily disintegratable upon total immersion in water and which comprises a plurality of layers or coatings including a hold-out film which is preferably composed of polyethylene, a thin continuous water-repellant coating thereon of waxy or paraffinic nature or of the nature set forth in co-pending application Ser. No. 738,203, filed June 19, 1968 and now U.S. Pat. No. 3,546,716 granted Dec. 15, 1970. and which may also be made of a silicate, silicone, siloxane, latex or cellulose derivative. Modified wax is preferred as in the aforesaid co-pending application, i.e., wax modified for adhesion and flexibility with from 1% to approximately 40% ethyl vinyl acetate polyethylene. While paraffin wax is preferred, other waxes such as microcrystalline, animal or vegetable, may also be used — especially where eventual breakdown, emulsification or biodegradability are required. Other copolymer polyethylenes such as ethylene ethyl acrylate and methacrylate may also be used as wax modifiers. Butyl and polyisobutylene synthetic rubbers may be substituted for the copolymer polyethylenes. In such case, the synthetic rubber content should range ideally from 5% to 8%. The wax may be further modified by the inclusion of stearic acid or other stearates and softened by the inclusion of lanolin, petrolatum or other wax softeners. The wax itself should preferably be paraffin with a low melting range (typically 138° to 142°F). The paraffin wax may also simply be modified with approximately 28% petrolatum or petroleum jelly. The additional ethyl vinyl acetate or synthetic rubber component are preferred when greater flex resistance is required.

Representative illustrative, non-limitative formulas for the secondary modified wax coating are as follows:

| | | | |
|---|---|---|---|
| 1. | 96 | parts by weight | paraffin wax |
| | 4 | parts by weight | ethyl vinyl acetate copolymer polyethylene (ELVAX 260) |
| | 100 | | |
| 2. | 88 | parts by weight | paraffin wax |
| | 12 | parts by weight | ethyl vinyl acetate copolymer polyethylene (ELVAX 260) |
| | 100 | | |
| 3. | 70 | parts by weight | paraffin wax |
| | 20 | parts by weight | microcrystalline wax |
| | 10 | parts by weight | ethyl vinyl acetate copolymer polyethylene (ELVAX 260) |
| | 100 | | |
| 4. | 60 | parts by weight | paraffin wax |
| | 30 | parts by weight | ethyl vinyl acetate copolymer polyethylene (ELVAX 260) |
| | 10 | parts by weight | petrolatum |
| | 100 | | |
| 5. | 50 | parts by weight | paraffin wax |
| | 30 | parts by weight | ethyl vinyl acetate copolymer polyethylene (ELVAX 260) |
| | 20 | parts by weight | petrolatum |
| | 100 | | |
| 6. | 50 | parts by weight | paraffin wax |
| | 20 | parts by weight | ethyl vinyl acetate copolymer polyethylene (ELVAX 260) |
| | 10 | parts by weight | microcrystalline wax |
| | 20 | parts by weight | petrolatum |

-continued

| | | | |
|---|---|---|---|
| | 100 | | |
| 7. | 74 | parts by weight | paraffin wax |
| | 6 | parts by weight | butyl or polyisobutylene synthetic rubber |
| | 20 | parts by weight | petrolatum |
| | 100 | | |
| 8. | 50 | parts by weight | paraffin wax |
| | 24 | parts by weight | microcrystalline wax |
| | 6 | parts by weight | butyl or synthetic rubber |
| | 20 | parts by weight | petrolatum |
| | 100 | | |
| 9. | 64 | parts by weight | paraffin wax |
| | 6 | parts by weight | butyl or polyisobutylene synthetic rubber |
| | 25 | parts by weight | microcrystalline wax |
| | 5 | parts by weight | lanolin |
| | 100 | | |
| 10. | 64 | parts by weight | paraffin wax |
| | 8 | parts by weight | butyl or polyisobutylene synthetic rubber |
| | 18 | parts by weight | microcrystalline wax |
| | 10 | parts by weight | lanolin |
| | 100 | | |
| 11. | 75 | parts by weight | paraffin or other wax |
| | 25 | parts by weight | petrolatum or petroleum jelly |
| | 100 | | |

The melting range of all the above formulas is at least 25° F higher than the temperature range of human feces, urine and vomit; the coating is therefore never in danger of being melted or dissolved by the heat of excreta or by the body in prolonged contact with it.

While a great variety of flexible water-repellent coatings without stretch properties can be formulated, the above examples are preferred because of their compounding simplicity, economical cost, and safety in terms of skin irritation, toxicity and allergic reaction. While solvents such as toluene may be used in the above formulas to decrease viscosity, this practice is not required and generally should be avoided because of danger from irritation to the skin and interference with chemical and microbiological testing of urine, feces, sputum, vomit and blood by the possibility of residual amounts of solvent remaining in the coating. These wax formulations, made without solvents, are also preferred over the numerous possible solvent-system or other coating formulations that may be substituted using other chemicals for the same reasons. Unlike latex, insoluble polyvinylalcohol and other aqueous formulations, the waxy coatings cover uniformly and present no drying problems.

A tissue paper layer of single or double-ply toilet or facial tissue quality is provided on both sides so that the sheet material and products made therefrom can be used from either side. The tissue paper layer adheres to the underlying material.

The invention is further illustrated in the accompanying drawing wherein.

Figure 1:
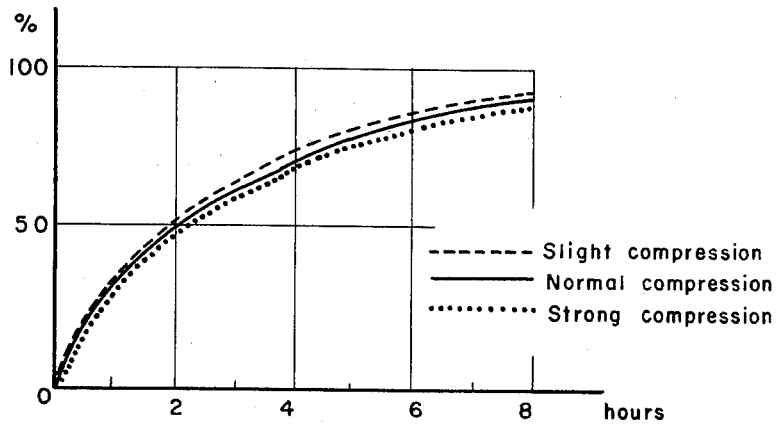
FIG. 1 is a perspective view of a three-layer sheet material according to the invention with a corner portion broken away to illustrate the construction.

The simplest form of the invention is shown in FIG. 1 and involves the use of a paper or non-woven paper-like fabric which is readily water-disintegratable or water-soluble and which is coated with an extremely thin layer of polyethylene (approximately 2 to 5 pounds per ream of 3000 square feet) or other suitable plastics or other hold-out materials which, when applied, will not sink into the paper. The hold-out polyethylene coating may be made of any low, medium, or high density polyethylene or copolymer (ethyl vinyl acetate or other) blend. Polypropylene and polypropylene copolymers, saran and polybutylene may also be used. The preferred means of depositing the hold-out layer is by extrusion coating. Other methods such as spraying molten polymer or depositing powdered polymer may also be used. The plastic coated paper is then reheated by hot air, infrared elements or other source of heat at temperatures exceeding approximately 300°F for 5 to 10 seconds in order to break down and totally eliminate the stretch characteristics of the polymer coating. This coating serves as a hold-out for the next layer. It does not serve as a water-repellent agent itself because, after flashing, it contains many fine pinholes which are subsequently filled by the modified wax top coating. The modified waxy or other insoluble coating is then applied to the polyethylene or other plastic hold-out layer and is made as thin as possible while still being continuous and rendering the sheet free, or substantially free, of pinholes. The sheet, when wetted on its coated side, repels water and maintains physical strength comparable to or slightly greater than the physical properties of the dry sheet of paper under the coating. When the uncoated side of the paper is wetted, however, the sheet disintegrates and tears much like a completely uncoated piece of the same paper. The insoluble coating exhibits no stretch properties of its own. It does not sink into the paper and therefore does not impart wet-strength qualities to the paper. A non-woven fabric may be substituted for the paper base sheet but it, too, must be water soluble. The non-woven material may be made of rayon, acetate, polyester or vinyon and in the dry state its fibers may be held together chemically (as with a polyvinyl alcohol, carboxy methyl cellulose or other water soluble binder) or by mechanical means. Upon immersion in water the fibers must readily separate and disperse. The initial polyethylene or other polymer hold-out coat is applied and its stretch properties eliminated by heat in the same manner as outlined with the paper substrate. The secondary modified wax coating is similarly applied.

Figure 2:
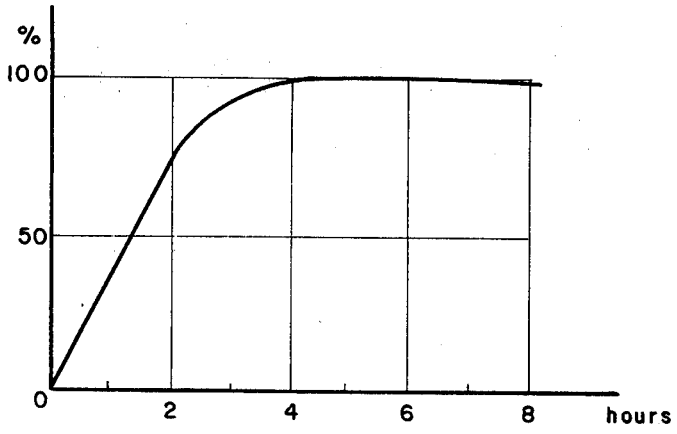
FIG. 2 is a view similar to FIG. 1, but wherein there is a tissue paper layer or coating on each side of the sheet material.
Figure 3:
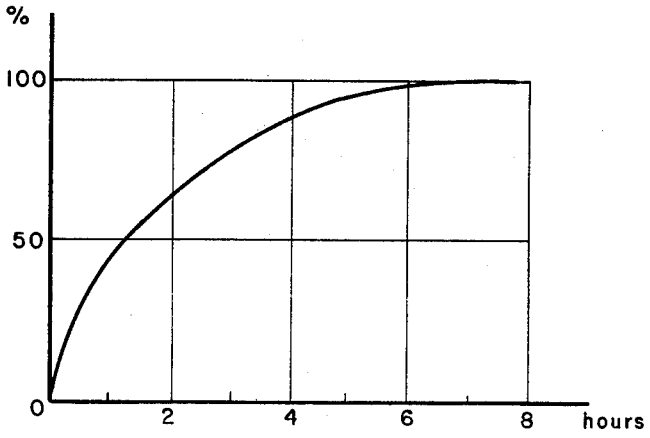
FIG. 3 is a view similar to FIG. 1, but wherein, as shown by the legends, two units are in effect combined into a multi-layered sheet material having two insoluble coatings in contact with one another, a polyethylene or other polyolefin layer on each side of the insoluble coatings and a tissue paper layer as the external layer on each side of the composite material.

In the forms of the invention shown in FIGS. 2 and 3, the sheet will repel water on either side and prevent its passage through the sheet while also maintaining physical strength comparable to the dry sheet of the paper. In this case, the bottom or dry sheet of paper supports the thin, flexible, pinhole-free but otherwise weak coating. When this layer of paper is also wetted (as when the entire sheet is immersed in water or in water in a toilet bowl) there remains no support for the coating and it easily ruptures, tears and disintegrates along with the paper.

The sheet displays these unique properties because (1) the two-step coating is not impregnated into the paper but rather rides on top of it or, in the case of FIGS. 2 and 3, between it, and (2) the coating itself, while pinhole-free and flex-resistant, is actually very weak and has no stretch properties. In forming the coating, polyethylene or other plastic material such as polypropylene, polybutylene or saran is used as a base hold-out coat for the subsequent modified wax waterproof layer. This is necessary to prevent the paper or non-woven fabric from becoming saturated with the wax and thereby resulting in an insoluble or wet-strength material. The polyethylene hold-out coating, itself, however, is treated to prevent it from exhibiting the usual stretching physical properties typical of even the thinnest coatings of polyethylene, polypropylene or other polymers. This is achieved by flashing the polyethylene coated paper for approximately 5 to 10 seconds at temperatures in excess of 300°F. Following flashing, the polyethylene coating no longer displays any of the usual stretching characteristics typical of even the thinnest films of polyethylene, polypropylene, polybutylene or saran. In order to achieve this break down of the stretch properties, the polyethylene must be applied in a coat no heavier than approximately 5 pounds per ream of 3000 square feet. When a paraffin wax, modified for flexibility according to the aforementioned formulas, is added in a hot melt coating operation, the prior polyethylene coating prevents the wax from impregnating the paper and achieves a flexible, pinhole-free water-repellent surface which, at the same time, has very little strength and tear resistance. The dry paper layers on either side of the coating provide the support necessary for the sheet to withstand weights of up to several pounds. When the bottom sheet is wetted, however, there remains no support for the film and it ruptures in numerous tears and pieces and is readily flushable in a toilet. By heating the modified wax to approximately 185° to 235° F, depending on the speed of the coating operation, the heat of the wax alone will break down the stretch characteristics of the polyethylene as it is applied by the coater while yet being held out from impregnating the paper by it. At temperatures lower than 185° F the stretch properties of the polymer hold-out coat will not be eliminated and the sheet, while water-repellent, will resist tearing much like a sheet of plastic film. At temperatures in excess of 235° F, and at coating speeds of less than 120 feet per minute, the wax will impregnate the paper by melting through the polyethylene coat. If a water-repellent coating other than hot melt is to be applied as from a solvent or aqueous system or where temperatures of approximately 185° to 235° F are not to be attained, prior flashing is necessary. The wax or other insoluble coating (such a nitrocellulose or other cellulose derivatives, lacquers, silicones, latexes, etc.) fills the pinholes resulting from flashing in the polyethylene hold-out coating but does not impregnate the paper sufficiently to form a wet-strength or water-insoluble sheet. The entire coated sheet is very thin and of the order of thickness set forth in the aforesaid co-pending application; namely, approximately 1/100th of an inch or less.

In the form of the invention shown in FIG. 2, there is an additional layer of uncoated tissue paper on the coated layer so that the sheet material of FIG. 2 has a tissue paper layer on each side, thereby making the material utilizable from either side in contrast to the form of the invention shown in FIG. 1.

In FIG. 3 there is illustrated a further form of the invention wherein greater thickness and/or somewhat greater strength and resistance are required and it will be observed that in this further modified sheet material according to the invention there are in effect two three-component units made up and assembled in contact with one another. This unit can be made by assembling two three-component units as indicated or could be made by forming and adhering the successive layers shown.

Figure 4:
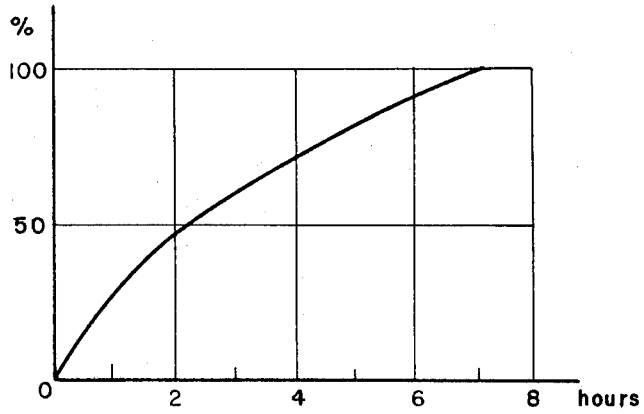
FIG. 4 is a plan view of a pan or basin having placed thereon a composite sheet material such as that of FIG. 5, the particular article being a bed-pan.
Figure 5:
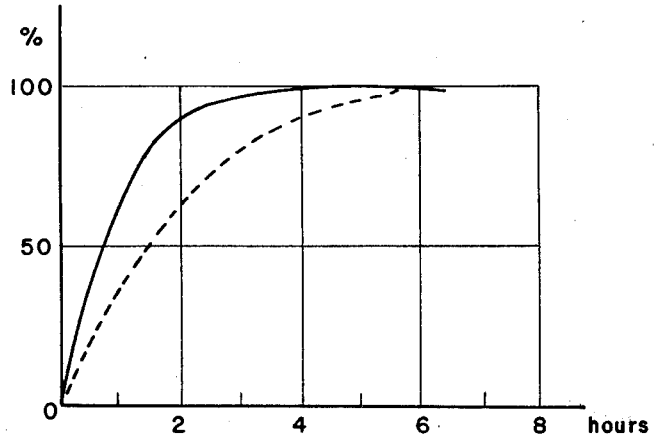
FIG. 5 is an actual view of the composite material taken along line 5—5 of FIG. 4, and FIGS. 6, 7 and 8 are views similar to FIG. 5 of further modified forms of the invention.

In FIGS. 4 and 5 there is shown a bed-pan of conventional nature in broken lines and designated B and disposed thereover is that form of the present invention appearing in FIG. 5 wherein in sequence from top to bottom there are layers of tissue paper or water soluble non-woven material, polyethylene wax and then an inverted set of the same materials but of smaller area. Each of the layers of material are individually the same as layers already described with reference to forms of the invention shown in FIGS. 1, 2 and 3 and since the materials are the same, it is unnecessary to specify the nature of these layers again. It will be seen by comparing FIGS. 4 and 5 that the 3-layer unit of larger area A extends beyond the basin or pan B on all sides whereas the 3-layer unit of lesser area C just covers the receiving opening of the basin or pan so that when excretions are disposed thereon the full benefits of the invention are obtained without the composite material being drawn into the basin or pan and rendered inconvenient of access.

Figure 6:
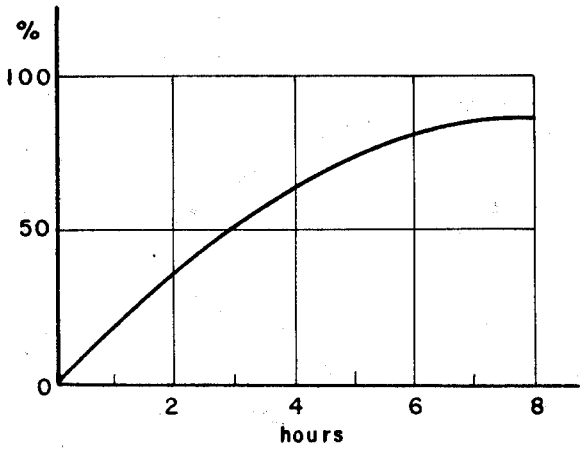
Figure 7:
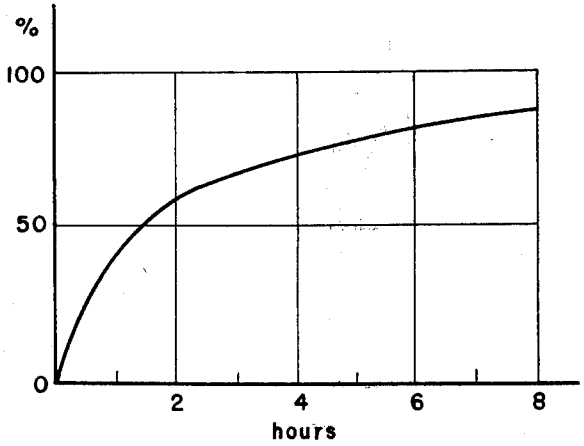
Figure 1:
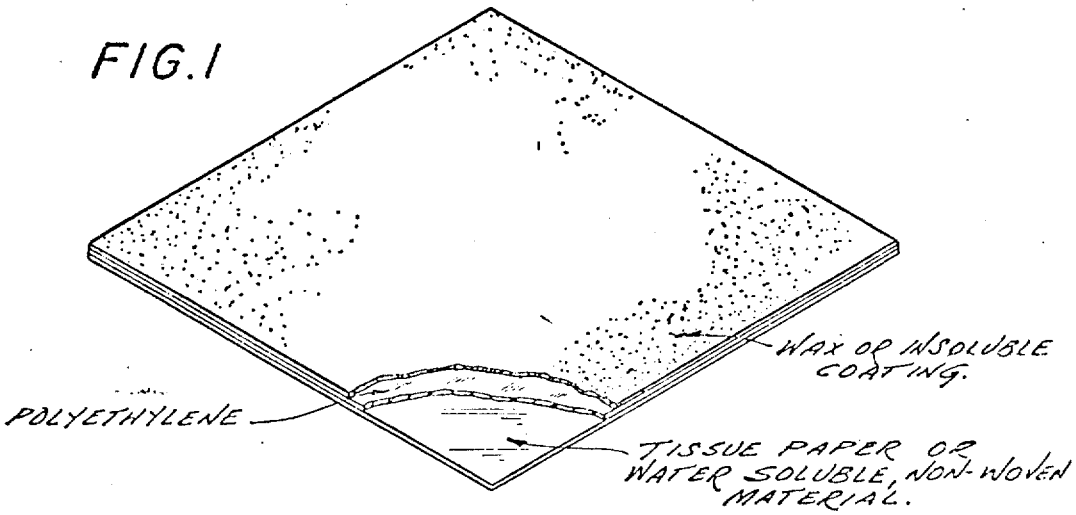
Figure 2:
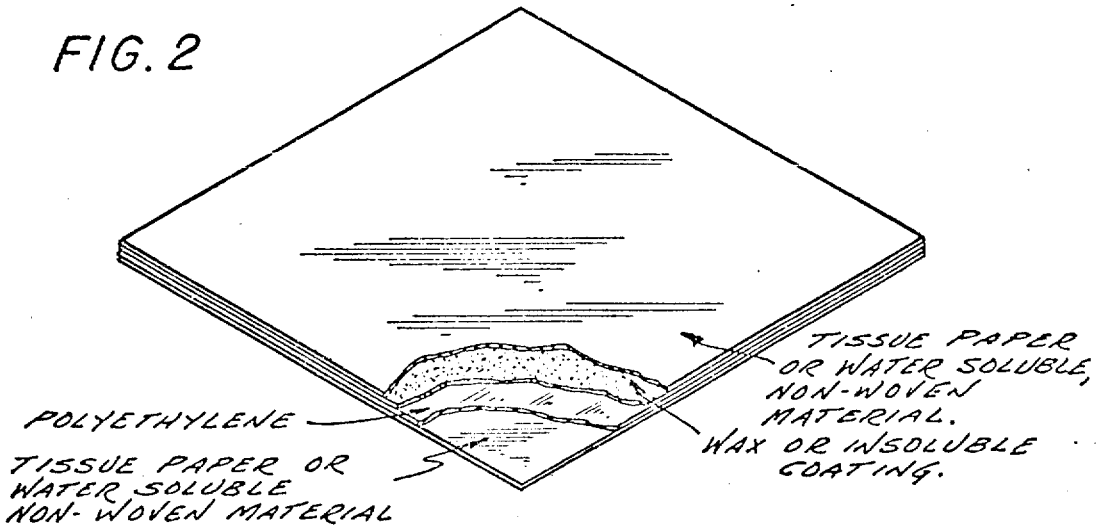
Figure 3:
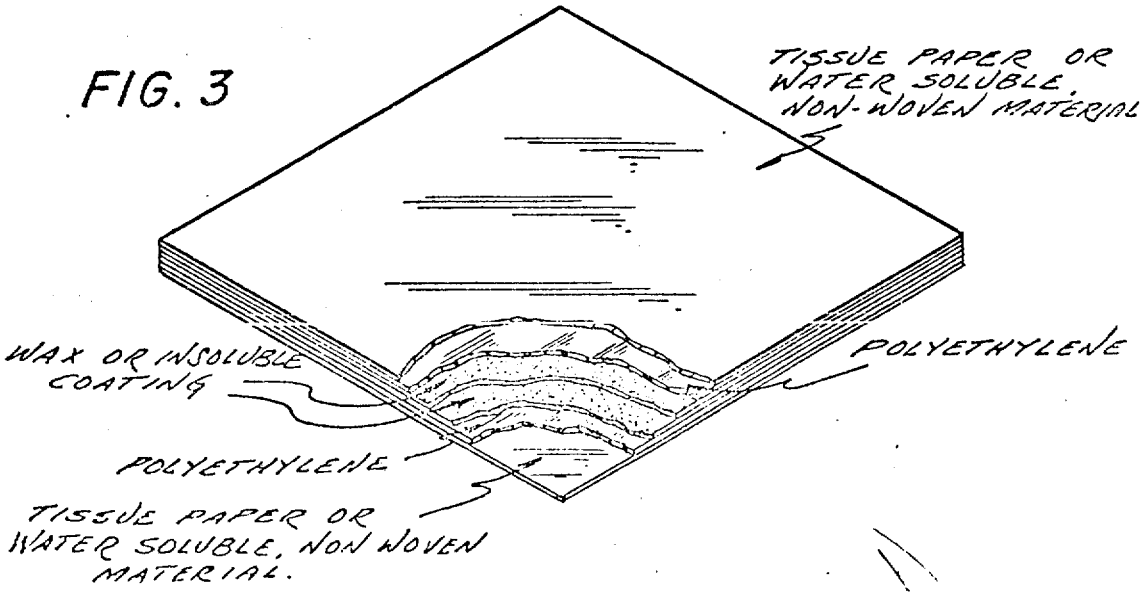
Figure 4:
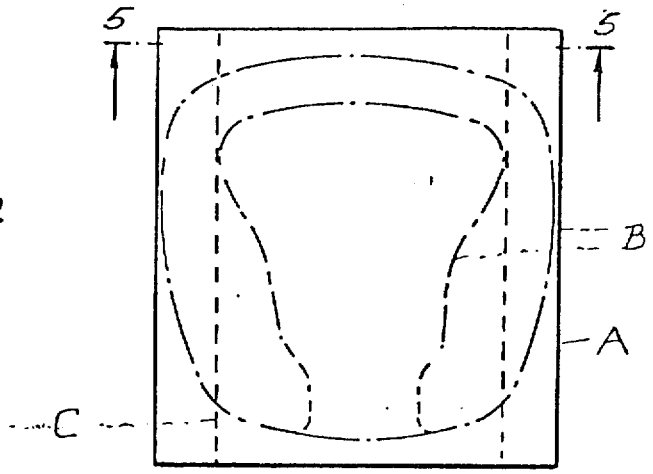
Figure 5:
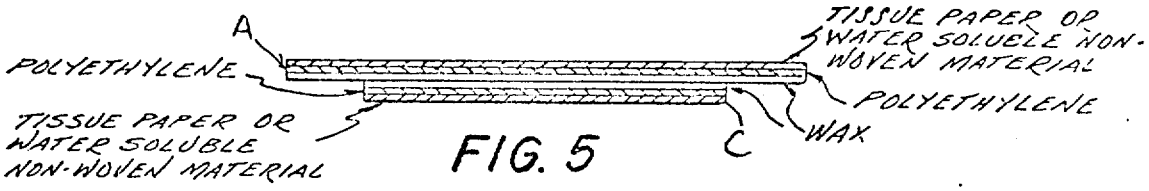
Figure 6:
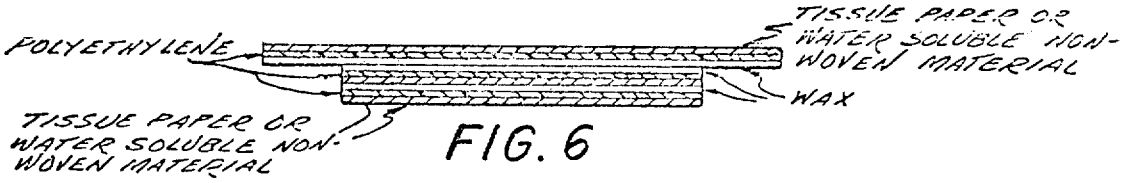
Figure 7:
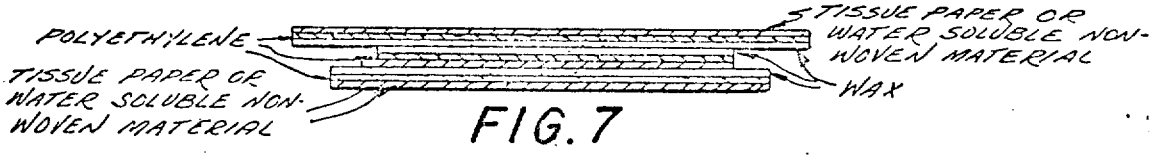
Figure 8:
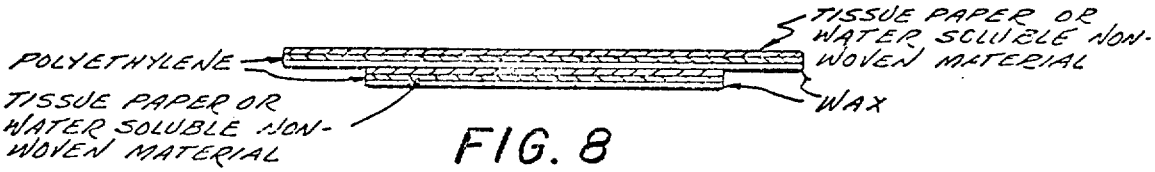

In the further modified form of the invention shown in FIG. 6 there are three 3-layer units wherein the uppermost unit illustrated is the same as A of FIG. 5 and the intermediate unit is the same as C of FIG. 5, but there is an additional unit with the wax layer uppermost and it will be further seen that the second and third units are the same size or area, whereas the uppermost unit is of considerably larger area. A further variation of this concept is shown in FIG. 7 wherein there are also three 3-layer units but each of which is of different size or area. For example the uppermost unit is the same as the unit A of FIG. 5, the intermediate unit is the same as unit C of FIG. 5, but the lowermost unit is intermediate in size or area, being smaller than the uppermost unit but larger than the intermediate unit. The materials of all the layers are the same as described above but the modification of FIG. 7 provides a little more strength and duration of time before disintegration when in contact with water or other liquids or moisture and furthermore is useful in connection with a pan or basin of the nature of that shown in FIG. 4 to provide greater coverage of the bottom of the pan or basin. The further form of the invention shown in FIG. 8 is the same as FIG. 5 except for the inversion of the lower 3-layer unit of smaller area because it is sometimes found that it is desirable and advantageous to have a wax or waxy layer in contact with the bottom of the basin or pan rather than a water-soluble or water-disintegratable layer as is the case in FIG. 5.

It will thus be appreciated that sheet material in accordance with this invention is versatile in that it can be made up of different combinations of substances or coatings and has great flexibility with little or no tendency to crack due to freezing, brittleness or drying out. Furthermore, the sheet material is of such character that when it comes in contact with water as, for example, that in a toilet or other disposal system, the tissue paper or water-soluble non-woven outer layers readily disintegrate thereby making the water-insoluble coating unable to retain its integrity so that the insoluble coating breaks up into a considerable number of pieces or fragments without the dry strength support of the water-disintegratable substrate. The tissue paper readily fragments and disintegrates also and hence the whole unit is readily disposable regardless of the number of layers or coatings involved. In addition, the variety of combinations of layers, coatings and sizes and arrangements of sheets renders the invention unusually versatile.

The sheet material of the present invention is primarily intended to be manufactured and sold in the form of large sheets or rolls or long strips which, for example, can have a width up to 72 inches or more if made on conventional equipment used by paper companies. Ultimately it is intended to cut the sheet material into suitable sizes and shapes to be employed in connection with hospital equipment such as flushable liners for bedpans and emesis basins wherein the pre-cut sheet material is used in the manner described in my aforesaid co-pending application, or liners for flushable disposable diapers and may be either cut into square sheets of 20 inches in length on each side as an example or into any other sizes and shapes whether such be rectangular, polygonal, circular or strip-like. The material is readily cut either by available cutters or by knives or scissors so that, for instance, a hospital, nursing home or clinic could purchase the sheet material of the invention in relatively large amounts or in rolls and then cut therefrom, as needed, the shapes wanted, but preferably the sheet material is pre-cut into a few different sizes and shapes for convenience. It will also be appreciated that the sheet material could be used as toilet flushable and disintegratable bacteria-proof toilet seat liners or covers, pet liners for pets to urinate and defecate on with none of the waste matter soaking through to rugs, etc., for disposable bibs, as a water-repellent disposable diaper liner, emesis basin liner, sanitary napkin liner, and for any other application where an article must be water-repellent and germ-repellent and strong yet should ideally be able to be flushed down a toilet without fear that it will clog the toilet or sewer because it will not disintegrate or break up in the sewage pipes and system. It is also to be understood that each of the forms of the invention can have a border of tissue paper or watersoluble non-woven material extending beyond the edges of the cut sheets, rolls or other shapes either on two opposite sides, on a single side or on all four sides as to finished liners and the like, thereby providing extra material for holding or grasping the articles, for handling or manipulating them or for application to larger than average or typical areas, bed-pans, basins, diapers, toilet sets, etc.

What is claimed is:

1. A method of producing a wax hold-out coating on water-disintegratable non-woven sheet without having the coating material penetrate the thin sheet or exhibit stretch properties, said hold-out coating being obtained by coating said sheet with an extremely thin layer of polymer on the order of from 2 to 5 pounds per 3000 square foot ream and subsequently flashing the coating with hot air at a temperature of at least 300°F for from 5 to 10 seconds.

2. A method according to claim 1 wherein the polymer is polyethylene.

3. A method of producing a hold-out coating on water-disintegratable paper of tissue quality without the coating penetrating the paper or exhibiting stretch properties, which comprises coating the paper with a thin layer of polyethylene in an amount of 2 to 5 pounds per 3000 square foot ream and applying thereover a waxy coating at a temperature of 185° to 235°F for coating speeds of about 100 to 250 feet per minute.

4. A method according to claim 3 wherein the waxy coating is microcrystalline wax having a melting range of about 138° to 142°F.

5. A method according to claim 4 wherein the wax is modified with petrolatum.

6. A method according to claim 4 wherein the wax is modified with petrolatum and ethylene vinyl acetate copolymer.

* * * * *

UNITED STATES PATENT OFFICE

CERTIFICATE OF CORRECTION

Patent No. 3,950,578 Dated April 13, 1976

Inventor(s) David H. E. Laumann Page 1 of 3

It is certified that error appears in the above-identified patent and that said Letters Patent are hereby corrected as shown below:

Substitute therefor the two sheets of drawings as shown on the attached sheets.

Signed and Sealed this

Seventeenth Day of August 1976

[SEAL]

*Attest:*

RUTH C. MASON
*Attesting Officer*

C. MARSHALL DANN
*Commissioner of Patents and Trademarks*